US005095558A

United States Patent [19]

Howard

[11] Patent Number: 5,095,558

[45] Date of Patent: Mar. 17, 1992

[54] ADJUSTABLE ORIFICE SPA JET

[75] Inventor: Herbert H. Howard, Woodland Hills, Calif.

[73] Assignee: Vortex Whirlpool Systems, Inc., Orange, Calif.

[21] Appl. No.: 586,237

[22] Filed: Sep. 21, 1990

[51] Int. Cl.[5] ..... A61H 33/02; A47K 3/10; E03C 1/084

[52] U.S. Cl. ..... 4/542; 4/559; 239/428.5

[58] Field of Search ..... 4/542, 541, 543, 544, 4/492, 491, 488, 507, 509, 559, 567, 496; 239/451, 456, 457, 428.5

[56] References Cited

U.S. PATENT DOCUMENTS

| | | | |
|---|---|---|---|
| 2,738,787 | 3/1956 | Jacuzzi et al. | 4/559 |
| 3,067,435 | 12/1962 | Nash | 4/492 |
| 3,273,560 | 9/1966 | Jacuzzi | 4/559 |
| 3,304,936 | 2/1967 | Kosta | 4/559 |
| 3,471,091 | 10/1969 | Baker | 239/428.5 |
| 3,540,438 | 11/1970 | Jacuzzi | 4/559 |
| 3,890,655 | 6/1975 | Mathis | 4/178 |
| 3,890,656 | 6/1975 | Mathis | 4/178 |
| 3,905,358 | 9/1975 | Jacuzzi | 4/559 |
| 3,946,449 | 3/1976 | Mathis | 4/178 |
| 4,082,091 | 4/1978 | Raab | 4/559 |
| 4,335,854 | 6/1982 | Reynoso | 239/428.5 |
| 4,408,721 | 10/1983 | Cohen et al. | 239/428.5 |
| 4,416,030 | 11/1983 | Reynoso | 4/492 |
| 4,542,854 | 9/1985 | Mathis | 239/587 |
| 4,671,463 | 6/1987 | Moreland et al. | 239/428.5 |
| 4,813,086 | 3/1989 | Henkin et al. | 4/542 |
| 4,985,943 | 1/1991 | Tobias et al. | 4/492 |

FOREIGN PATENT DOCUMENTS

| | | | |
|---|---|---|---|
| 0168823 | 1/1986 | European Pat. Off. | 4/542 |
| 0215514 | 3/1987 | European Pat. Off. | 4/542 |
| 0372642 | 6/1990 | European Pat. Off. | 4/541 |
| 3820349 | 12/1989 | Fed. Rep. of Germany | 4/541 |
| 2112670 | 7/1983 | United Kingdom | 4/542 |
| 90/03774 | 4/1990 | World Int. Prop. O. | 4/542 |

*Primary Examiner*—William A. Cuchlinski, Jr.
*Assistant Examiner*—John L. Beres
*Attorney, Agent, or Firm*—Kelly Bauersfeld & Lowry

[57] ABSTRACT

An improved adjustable orifice spa jet is provided for use in a spa, therapeutic bath, and the like, wherein the spa jet supplies a diverging annular flow stream of mixed air and water. The spa jet includes a housing defining a chamber with a cylindrical discharge outlet at one end and a pressurized water and an air inlet at the opposite end. A nozzle includes a hollow eyeball fitting mounted pivotally within the chamber and defining a venturi section for admixture of air and water. The nozzle further includes a diverging annular discharge flow path for discharge flow of the air-water mixture to the spa. In the preferred form, the nozzle is directionally adjustable from within the spa and includes curved swirl vanes to impart a swirling action to the fluid flow for improved massage action. The preferred nozzle further includes an adjustment knob accessible from within the spa to variably select a desired air-water mixing ratio.

14 Claims, 3 Drawing Sheets

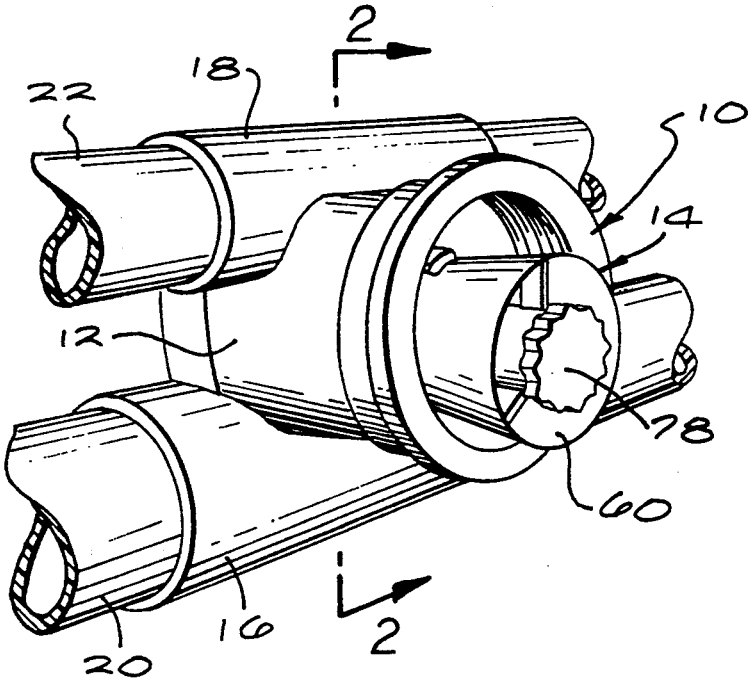
FIG. 1
FIG. 3
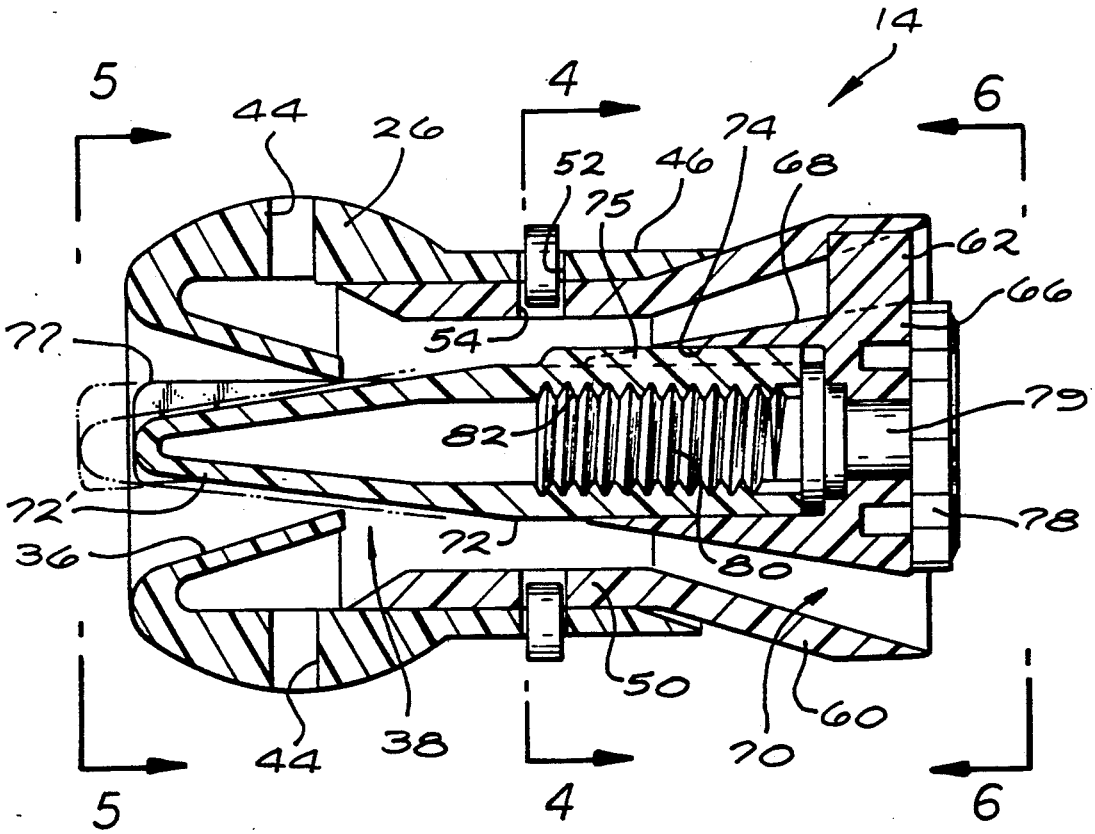

ADJUSTABLE ORIFICE SPA JET

BACKGROUND OF THE INVENTION

This invention relates generally to improvements in aerator jets or nozzles for spas, hot tubs, therapeutic baths and the like. More particularly, the invention is directed to an improved spa jet designed for enhanced therapeutic action and improved flow adjustment features.

Water jet aerators have been utilized extensively in conjunction with spas, tubs, baths, and the like to provide aerated water or an air-water jet stream which may be directed against a person's body to provide a therapeutic massage action. Typically, the aerator includes a nozzle for discharging a water jet into a cavity which creates a vacuum or suction by venturi action to draw and mix ambient air with the water stream. The resulting air-water mixture is then discharged through an elongated conduit having a typically tubular shape for delivering the stream into the spa or tub. In this regard, the aerator normally incorporates an eyeball fitting to permit pivotal directional adjustment of the nozzle.

In the past, water jet aerators of this general type have exhibited a variety of inherent limitations and disadvantages. For example, the tubular discharge conduit used to direct the mixed air-water stream into the spa has inherently provided a relatively narrow range or field of therapeutic action. In spite of directional adjustment features, it has not been possible for relatively broad skin areas to receive a vigorous massage action attributable to the discharge stream from a single aerator. Moreover, such prior devices have generally been difficult to adjust, especially with respect to adjusting the mixing ratio of air and water from within the spa and without interrupting air and water flow.

There exists, therefore, a need for an improved spa jet or aerator of relatively simple design to provide a relatively broad range of vigorous massage action, and wherein the spa jet is easily adjusted from within the spa. The present invention fulfills these needs and provides further related advantages.

SUMMARY OF THE INVENTION

In accordance with the invention, an improved adjustable orifice spa jet is provided for a spa, tub, bath, and the like. The improved spa jet supplies a pressurized stream of mixed water and air in the form of a directionally adjustable diverging annulus. The spa jet further includes means accessible from within the spa to regulate and select a preferred air and water mixing ratio.

The spa jet includes a housing defining a chamber having a cylindrical discharge opening at one end, and a pressurized water inlet and an ambient air inlet at the other end. A movable nozzle includes a hollow eyeball fitting pivotally mounted within the chamber and defining a venturi section through which the pressurized water flows to draw and mix with ambient air. The resultant air-water mixture is directed through a discharge passage of diverging annular shape for flow into the spa. This diverging annulus is defined by a diverging outer nozzle wall in combination with a central core plug. The annular and diverging geometry of the discharge stream provides a broad area of vigorous massage action.

In accordance with further features of the invention, an adjustment knob accessible from within the spa is connected to the core plug for axially adjusting a tapered rear end of the core plug relative to the venturi section to regulate the ratio of air and water in the mixed stream. Moreover, guide vanes of preferably curved shape are included along the diverging discharge passage to impart a swirling action to the annular stream.

Other features and advantages of the present invention will become apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view of the adjustable orifice spa jet of the present invention;

FIG. 3 is an enlarged transverse vertical sectional view of a nozzle for the adjustable orifice spa jet of FIG. 2;

DESCRIPTION OF THE PREFERRED EMBODIMENT

Figure 2:
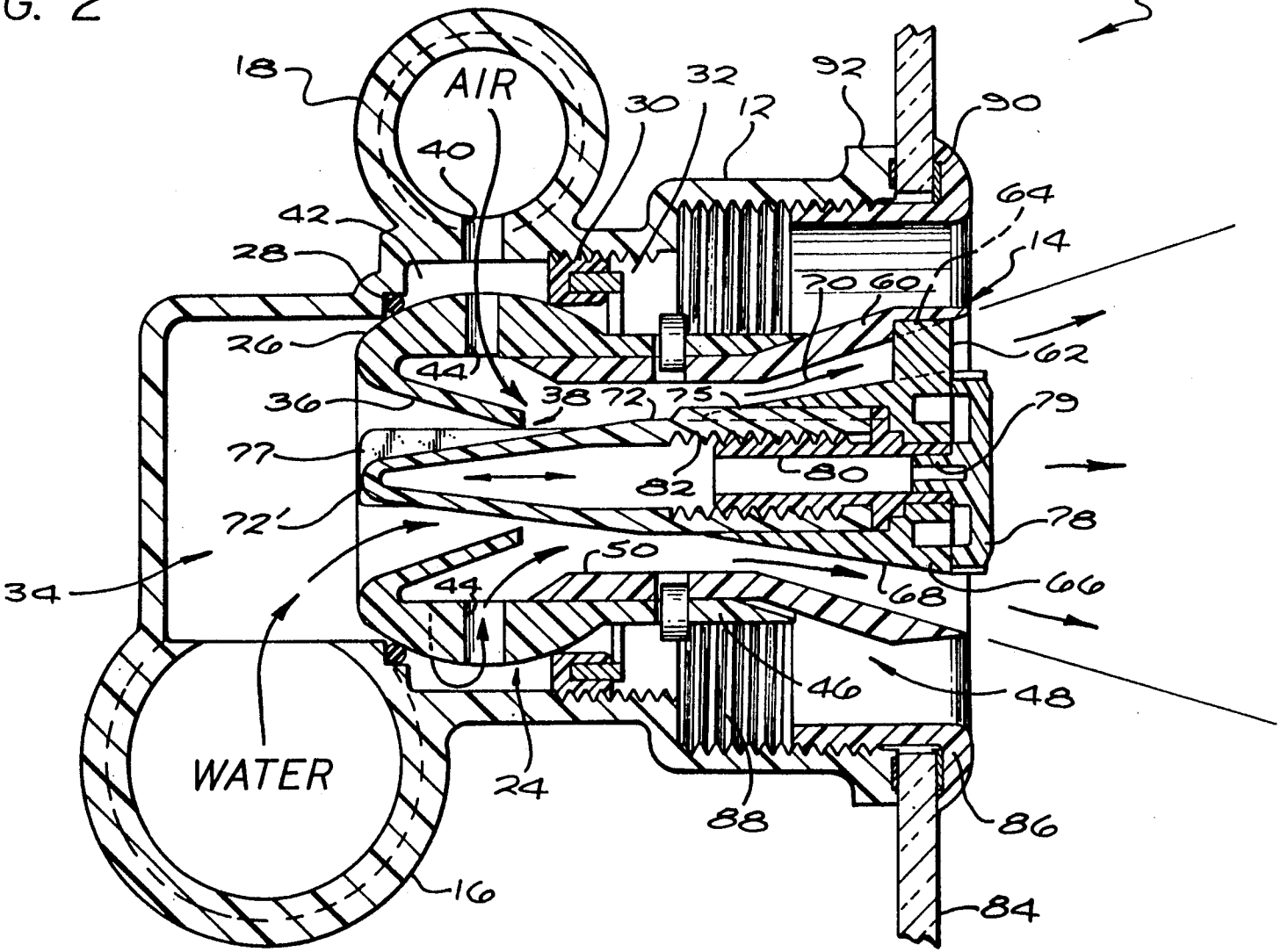
FIG. 2 is a vertical transverse sectional view taken generally on the line 2—2 of FIG. 1.

As shown in the exemplary drawings, an improved adjustable orifice spa jet is referred to generally in FIG. 1 by the reference numeral 10. The spa jet 10 generally comprises a housing 12 adapted for separately receiving a supply of water under pressure and a supply of air. A nozzle 14 is movably mounted within the housing 12 and includes means for adjustably mixing the water and air in a variably selected ratio, and for discharging a mixed air-water flow stream as a diverging annular flow stream into the body of water within a spa or tub or the like.

The adjustable spa jet 10 of the present invention is adapted for installation into the plumbing network of a conventional spa or the like to provide a highly pleasing and therapeutic hydromassage action. In this regard, the illustrative drawings show the housing 12 joined or otherwise suitably connected to a water inlet tube 16 and an air inlet tube 18, with the tubes 16 and 18 being adapted in turn for in-line connection with a water supply conduit 20 and an air supply conduit 22, respectively, which are typically connected to additional spa jets (not shown) in a hydrotherapy massage apparatus. Importantly, the diverging annular air-water flow stream discharged from the nozzle 14 into the body of water within the spa provides an extremely effective massage therapy over a broad area or zone. The specific degree of massage action can be individually regulated and/or directed by a person within the spa, without removal of any spa jet components, and further without requiring interruption of air or water flow.

As viewed best in FIG. 2, the housing 12 for the spa jet 10 includes a central chamber 24 having a size and shape for anchored mounting of the nozzle 14. More specifically, a rear portion of the nozzle 14 (FIGS. 2 and 3) is defined by a generally spherical eyeball fitting 26 adapted to seat upon a seal ring 28 at a rear edge of the central chamber 24. A lock ring 30 is sized for threaded advancement into an internally threaded zone 32 within a forward extent of the central chamber 24, wherein this lock ring 30 is adapted to engage and retain the eyeball fitting 26 against the rear seal ring 28. As is known in the spa fitting art, the force of bearing engagement of the lock ring 30 against the eyeball fitting 26 provides a variable frictional resistance to swivel motion of the eyeball fitting for directionally adjusting the discharge flow from the nozzle 14.

The water inlet tube 16 communicates a pressurized source of water into a rear plenum chamber 34 disposed within the housing 12 immediately to the rear of the central chamber 24. From the rear plenum chamber 34, the water is free to flow forwardly into a converging nozzle segment 36 at the rear of the eyeball fitting 26. The water flow is thus accelerated through the nozzle segment 36 and passes into the hollow interior 38 of the eyeball fitting 26 for mixture therein with ambient air.

The air supply tube 18 is normally connected at a suitable site to ambient air, although a booster pump (not shown) may be used to deliver air under pressure. The interior of the air supply tube is open via a port 40 in the housing 12 to permit air flow into an annular region 42 surrounding the eyeball fitting 26. The air is further free to flow from the region 42 through a series of radially open apertures 44 in the eyeball fitting 26 for mixture within the eyeball fitting with the water flow. In this regard, as depicted in the illustrative drawings, the eyeball fitting 26 defines a venturi section such that water flow into the interior 38 of the eyeball fitting functions to draw air for admixture therewith. If desired, a check valve (not shown) can be installed into the air port 40 to prevent unwanted water flow into the air supply tube 18.

Figure 4:
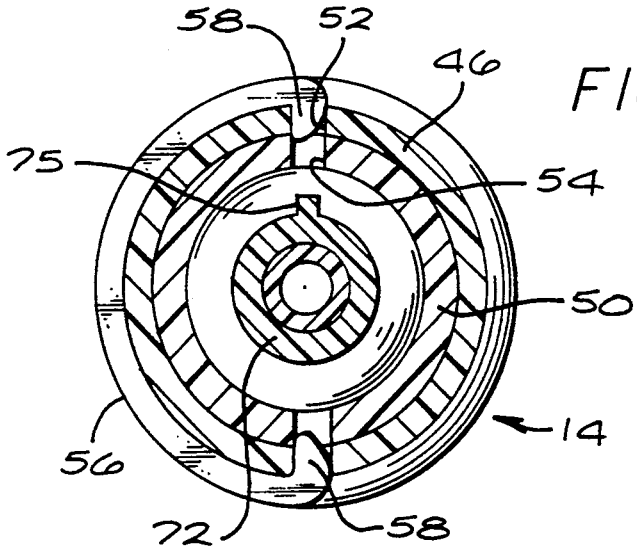
FIG. 4 is a transverse vertical sectional view taken generally on the line 4—4 of FIG. 3.

As shown in FIGS. 2 and 3, the eyeball fitting 26 is joined to a forwardly projecting cylindrical segment 46 which extends a short distance into an enlarged cylindrical forward chamber 48 at a front end of the spa jet housing 12. This cylindrical segment 46 is sized and shaped for close sliding reception of a smaller cylindrical segment 50 of a nozzle discharge section. Aligned apertures 52 and 54 are conveniently formed in the telescoped segments 46 and 50 to permit axial interlocking by means of a C-shaped spring 56 having internal end tabs 58 as shown in FIG. 4.

Figure 6:
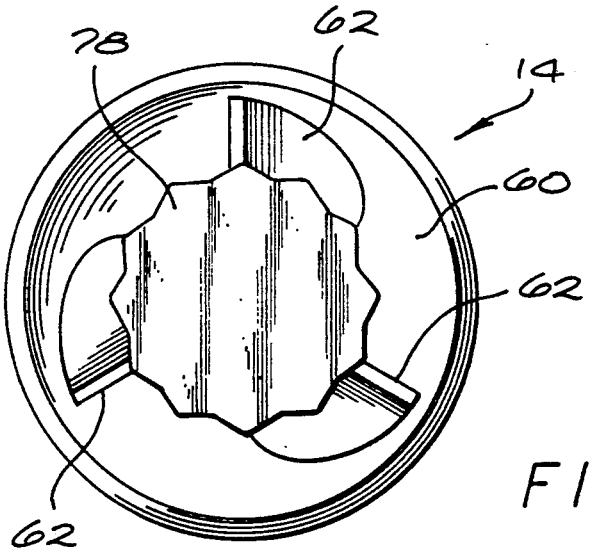
FIG. 6 is a front end elevational view taken generally on the line 6—6 of FIG. 3.

The inner cylindrical segment 50 projects forwardly with a substantially uniform diameter to a forward margin of the outer segment 46, whereat the inner segment 50 is joined to a forwardly projecting and outwardly diverging nozzle wall 60. This nozzle wall 60 defines the outer diametric size of the diverging annular flow of mixed air and water discharged from the spa jet 10. A series of radially inwardly extending vanes 62 are suitable secured to the nozzle wall 60, as by adhesive mounting of the outermost vane edges within shallow preformed slots 64 formed in the nozzle wall 60. The radially inner edges of the vanes 62, three of which are depicted in FIG. 6, are joined in turn to an inner retainer sleeve 66 disposed generally in axial alignment with the converging nozzle segment 36 within the eyeball fitting 26. An outer surface of revolution 68 defined by the retainer sleeve 66 is also diverging in a direction toward a forward end of the spa jet 10, such that the diverging surface 68 cooperates with the nozzle wall 60 to define a diverging annular nozzle passage 70 through which the mixed air and water flow into the spa. This diverging annular air-water stream discharged into the spa provides a broad area or field of vigorous massage action, wherein the massage action can be further enhanced by forming the vanes 62 with a curved shape, as viewed in FIG. 6, to impart a swirling action to the annular stream.

Figure 5:
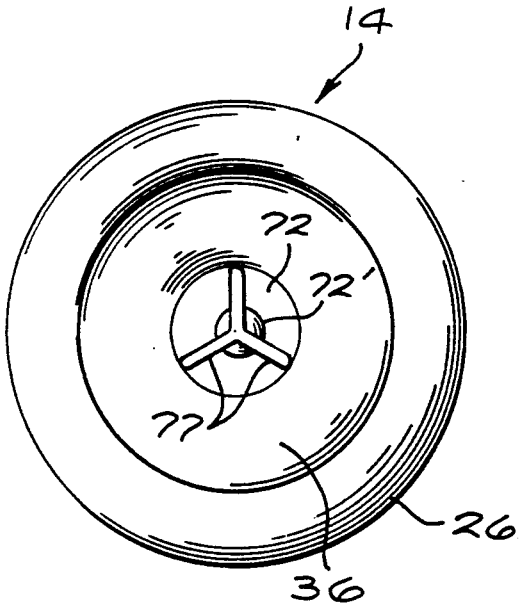
FIG. 5 is a rear end elevational view of the nozzle taken generally on the line 5—5 of FIG. 3.

In accordance with one aspect of the invention, the retainer sleeve 66 supports a central core plug 72 which projects rearwardly to a position generally within the converging nozzle segment 36 to permit variable regulation of the air-water mixing ratio. More specifically, the retainer sleeve 66 includes an axially elongated slot 74 for receiving an axially elongated rib 75 on the core plug 72. The core plug 72 projects rearwardly from the retainer sleeve 66 and defines a rearwardly tapered section 72' of narrowing cross sectional size protruding into and through the nozzle segment 36. The slotted slide-fit engagement between the core plug 72 and the retainer sleeve 66 permits the core plug to be shifted axially in the fore-aft direction to vary the specific size portion of the tapered section 72' disposed at a forward margin of the nozzle segment 36. Such adjustment effectively varies the size of an annular water flow path through the nozzle segment into the interior 38 of the eyeball fitting 26, and thereby effectively regulates the water flow rate and the resultant mixing ratio of water and air. Radially protruding vanes 77 (FIG. 5) on the tapered section 72' are conveniently provided to maintain the core plug 72 centered within the nozzle segment.

The core plug 72 is axially adjusted by means of a control knob 78 located at a forward end of the retainer sleeve 66 in a position easily accessible to a person within the spa. The knob 78 preferably has an easily grasped noncircular cross sectional shape, and defines a small hub 79 drivingly connected to a lead screw 80 mounted rotatably within the retainer sleeve 66. This lead screw 80 is threadably engaged with a threaded zone 82 on the core plug 72, such that control knob rotation effectively displaces the core plug fore-aft to regulate water flow, and thereby correspondingly regulate the air-water mixing ratio.

As shown in FIG. 2, the entire housing 12 is installed quickly and easily onto the wall 84 of a spa by means of a standard mounting ring 86 threadably engaged into an internally threaded segment 88 lining the forward chamber 48. In this position, an outwardly radiating flange 90 on the mounting ring 86 cooperates with a similar flange 92 on the housing 12 to securely lock the housing in place.

In normal operation, water inflow through the converging nozzle segment 36 within the eyeball fitting 26 draws in ambient air for mixture with the water flow within the interior 38 of the eyeball fitting. The rate of water flow, and the proportional mixing ratio with the ambient air are closely regulated by adjustment of the control knob 78 to variably adjust the fore-aft position of the core plug 72. Control knob rotational adjustment is easily performed from within the spa by a person using the spa to provide individual regulation of the desired hydromassage therapy action. The resultant mixed air and water flow stream then passes through the annular diverging passage 70 in the forward nozzle section for discharge into the spa. This diverging and annular stream geometry provides a broad field or area of massage action to permit simultaneous massage therapy over an extended surface area of the body, and with a vigorous action which is substantially uniform over the entire effective area. Moreover, the swivel connection of the eyeball fitting 26 within the housing 12 permits the nozzle 14 to be directionally adjusted to aim the diverging flow stream in a desired direction.

The improved adjustable spa jet 10 is relatively simple in construction and is easily adjusted. Further, the various components of the spa jet are designed for economical manufacture from relatively lightweight molded plastic materials.

A variety of modifications and improvements to the adjustable orifice spa jet described herein are believed to be apparent to those skilled in the art. Accordingly, no limitation on the present invention is intended by way of the foregoing description or the accompanying drawings, except as set forth in the appended claims.

What is claimed is:

1. An adjustable orifice spa jet for mixing and discharging an air-water stream, said jet comprising:

a housing defining a chamber having a discharge opening at a front end thereof, and a water inlet and an air inlet disposed generally at a rear end thereof; and a nozzle mounted within said housing chamber, said nozzle including means communicating with said water and air inlets for mixing water and air to form the air-water stream, and means including an outer diverging annular nozzle wall and an inner substantially nonconvergent annular nozzle wall cooperatively defining a diverging annular passage for flow of the air-water stream outwardly from said front end of said housing chamber in the shape of an annular diverging flow stream.

2. The adjustable orifice spa jet of claim 1 further including means for selectively adjusting a mixing ratio of the water and air.

3. The adjustable orifice spa jet of claim 2 wherein said adjusting means comprises a control knob accessible from said front end of said housing chamber.

4. The adjustable orifice spa jet of claim 1 wherein said mixing means comprises a venturi section formed within said nozzle.

5. The adjustable orifice spa jet of claim 1 wherein said nozzle includes an eyeball fitting, said housing including means for pivotally mounting said eyeball fitting within said chamber to permit pivotal directional adjustment of said nozzle to select the direction of discharge of said annular diverging flow stream.

6. The adjustable orifice spa jet of claim 1 wherein said mixing means comprises a converging nozzle section formed within said nozzle at a rear end thereof and defining a venturi for accelerated passage of a water flow therethrough to draw air into the water flow through radially open ports communicating with said air inlet, and further including means for variably adjusting a mixing ratio of water and air, said means for variably adjusting comprising a central core plug having a tapered portion extending into said converging nozzle section, and means accessible from a front end of said nozzle for axially translating said core plug within said converging nozzle section.

7. The adjustable orifice spa jet of claim 1 further including a plurality of curved swirl vanes formed along said discharge passage for imparting a swirl flow to said annular diverging flow stream.

8. The adjustable orifice spa jet of claim 1 further including means for mounting said housing onto a wall of a spa.

9. An adjustable orifice spa jet for mixing and discharging an air-water stream, said jet comprising:

a housing defining a chamber having a discharge opening at a front end thereof, and a water inlet and an air inlet generally at a rear end thereof; and a nozzle mounted within said chamber, said nozzle including an eyeball fitting at a rear end thereof and pivotally mounted within said chamber, said eyeball fitting including a venturi section in communication with said water and air inlets for mixing water and air to form the air-water stream, said nozzle further including a discharge section at a front end thereof and including an outer diverging annular nozzle wall and an inner substantially nonconvergent annular nozzle wall cooperatively defining a diverging annular flow passage for flow of the air-water stream from said venturi section and discharge from said housing as a diverging annular stream.

10. The adjustable orifice spa jet of claim 9 further including a plurality of swirl vanes mounted along said diverging annular flow passage.

11. The adjustable orifice spa jet of claim 9 wherein said venturi section is defined by a converging nozzle segment formed within said eyeball fitting, and further including a core plug mounted on said discharge section and having a tapered portion extending into said nozzle segment, and control means mounted on said discharge section and accessible from said front end of said nozzle for adjusting the position of said core plug relative to said nozzle segment to variably select a mixing ratio of water and air.

12. The adjustable orifice spa jet of claim 11 wherein said control means comprises a control knob rotatably mounted on said front end of said nozzle, and lead screw means connected between said control knob and said core plug for adjusting the position of said core plug upon rotation of said control knob.

13. The adjustable orifice spa jet of claim 12 wherein said control knob is rotatably mounted on a retainer sleeve at said front end of said nozzle, and further including means for preventing rotation of said core plug relative to said retainer sleeve.

14. The adjustable orifice spa jet for mixing and discharging an air-water stream, said jet comprising:

a housing defining a chamber having a discharge opening at a front end thereof, and a water inlet and an air inlet disposed generally at a rear end thereof;

a nozzle mounted within said housing chamber, said nozzle including venturi means communicating with said water and air inlets for mixing water and air to form the air-water stream, and means including an outer diverging annular nozzle wall and an inner substantially nonconvergent annular nozzle wall cooperatively defining a diverging annular passage for flow of the air-water stream outwardly from said front end of said housing chamber in the shape of an annular diverging flow stream;

means for adjusting the discharge direction of said annular diverging annular flow stream; and means for adjusting a mixing ratio of air and water within said annular diverging annular flow stream.

* * * * *